US009371699B2

(12) United States Patent
Richert et al.

(10) Patent No.: US 9,371,699 B2
(45) Date of Patent: Jun. 21, 2016

(54) PLOW-SHAPED CUTTING ELEMENTS FOR EARTH-BORING TOOLS, EARTH-BORING TOOLS INCLUDING SUCH CUTTING ELEMENTS, AND RELATED METHODS

(71) Applicant: Baker Hughes Incorporated, Houston, TX (US)

(72) Inventors: Volker Richert, Celle/Gross-Hehlen (DE); Nicholas J. Lyons, Rio de Janeiro (BR)

(73) Assignee: Baker Hughes Incorporated, Houston, TX (US)

( * ) Notice: Subject to any disclaimer, the term of this patent is extended or adjusted under 35 U.S.C. 154(b) by 611 days.

(21) Appl. No.: 13/661,605

(22) Filed: Oct. 26, 2012

(65) Prior Publication Data

US 2013/0112485 A1 May 9, 2013

Related U.S. Application Data

(60) Provisional application No. 61/551,729, filed on Oct. 26, 2011.

(51) Int. Cl.

| | |
|---|---|
| ***E21B 10/46*** | (2006.01) |
| ***E21B 10/52*** | (2006.01) |
| ***E21B 10/50*** | (2006.01) |
| ***E21B 10/48*** | (2006.01) |
| ***E21B 10/567*** | (2006.01) |

(52) U.S. Cl.

CPC ..... *E21B 10/46* (2013.01); *E21B 10/48* (2013.01); *E21B 10/50* (2013.01); *E21B 10/5673* (2013.01); *E21B 10/5676* (2013.01)

(58) Field of Classification Search

CPC ..... E21B 10/46; E21B 10/48; E21B 10/50; E21B 10/5673; E21B 10/5676; E21B 10/55; E21B 10/58; E21B 10/52; E21B 10/16

See application file for complete search history.

(56) References Cited

U.S. PATENT DOCUMENTS

| | | | | |
|---|---|---|---|---|
| 4,819,516 | A * | 4/1989 | Dennis | 76/101.1 |
| 4,872,520 | A * | 10/1989 | Nelson | 175/430 |
| 5,560,440 | A * | 10/1996 | Tibbitts | 175/384 |
| 5,649,604 | A * | 7/1997 | Fuller et al. | 175/431 |
| 6,065,552 | A * | 5/2000 | Scott et al. | 175/374 |
| 6,332,503 | B1 * | 12/2001 | Pessier et al. | 175/336 |
| 2006/0131075 | A1 * | 6/2006 | Cruz | 175/57 |
| 2012/0023833 | A1 | 2/2012 | Hall et al. | |

* cited by examiner

*Primary Examiner* — Kenneth L Thompson
*Assistant Examiner* — Carib Oquendo
(74) *Attorney, Agent, or Firm* — TraskBritt

(57) ABSTRACT

A cutting element for an earth-boring tool includes at least one volume of superabrasive material on a substrate. The volume of superabrasive material includes a first planar surface and a second planar surface oriented at an angle relative to the first planar surface and intersecting the first planar surface along an apex. The first planar surface has a circular or oval shape having a first maximum diameter, and the second planar surface has a circular or oval shape having a second maximum diameter. The apex has a length less than the first maximum diameter and the second maximum diameter. Earth-boring tools includes such a cutting element attached to a body. Methods of forming earth-boring tools include the attachment of such a cutting element to a body of an earth-boring tool.

20 Claims, 7 Drawing Sheets

PLOW-SHAPED CUTTING ELEMENTS FOR EARTH-BORING TOOLS, EARTH-BORING TOOLS INCLUDING SUCH CUTTING ELEMENTS, AND RELATED METHODS

CROSS-REFERENCE TO RELATED APPLICATION

This application claims the benefit of U.S. Provisional Patent Application Ser. No. 61/551,729, filed Oct. 26, 2011, in the name of Richert, et al., the disclosure of which is hereby incorporated herein in its entirety by this reference.

FIELD

Embodiments of the present disclosure relate to polycrystalline diamond compact cutting elements for earth-boring tools, to earth-boring tools including such cutting elements, and to methods of methods of making and using such cutting elements and earth-boring tools.

BACKGROUND

Earth-boring tools are commonly used for forming (e.g., drilling and reaming) bore holes or wells (hereinafter "wellbores") in earth formations. Earth-boring tools include, for example, rotary drill bits, coring bits, eccentric bits, bicenter bits, reamers, underreamers, and mills.

Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is attached, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

Fixed-cutter drill bits typically include a plurality of cutting elements that are attached to a face of bit body. The bit body may include a plurality of wings or blades, which define fluid courses between the blades. The cutting elements may be secured to the bit body within pockets formed in outer surfaces of the blades. The cutting elements are attached to the bit body in a fixed manner, such that the cutting elements do not move relative to the bit body during drilling. The bit body may be formed from steel or a particle-matrix composite material (e.g., cobalt-cemented tungsten carbide). In embodiments in which the bit body comprises a particle-matrix composite material, the bit body may be attached to a metal alloy (e.g., steel) shank having a threaded end that may be used to attach the bit body and the shank to a drill string. As the fixed-cutter drill bit is rotated within a wellbore, the cutting elements scrape across the surface of the formation and shear away the underlying formation.

The cutting elements used in such earth-boring tools often include polycrystalline diamond cutters (often referred to as "PDCs"), which are cutting elements that include a polycrystalline diamond (PDC) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HTHP process.

Upon formation of a diamond table using an HTHP process, catalyst material may remain in interstitial spaces between the grains or crystals of diamond in the resulting polycrystalline diamond table. The presence of the catalyst material in the diamond table may contribute to thermal damage in the diamond table when the cutting element is heated during use due to friction at the contact point between the cutting element and the formation. Polycrystalline diamond cutting elements in which the catalyst material remains in the diamond table are generally thermally stable up to a temperature of about 750° Celsius, although internal stress within the polycrystalline diamond table may begin to develop at temperatures exceeding about 350° Celsius. This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about 750° Celsius and above, stresses within the diamond table may increase significantly due to differences in the coefficients of thermal expansion of the diamond material and the catalyst material within the diamond table itself. For example, cobalt thermally expands significantly faster than diamond, which may cause cracks to form and propagate within the diamond table, eventually leading to deterioration of the diamond table and ineffectiveness of the cutting element.

In order to reduce the problems associated with different rates of thermal expansion in polycrystalline diamond cutting elements, so-called "thermally stable" polycrystalline diamond (TSD) cutting elements have been developed. Such a thermally stable polycrystalline diamond cutting element may be formed by leaching the catalyst material (e.g., cobalt)

out from interstitial spaces between the diamond grains in the diamond table using, for example, an acid. All of the catalyst material may be removed from the diamond table, or only a portion may be removed. Thermally stable polycrystalline diamond cutting elements in which substantially all catalyst material has been leached from the diamond table have been reported to be thermally stable up to a temperature of about 1200° Celsius. It has also been reported, however, that such fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only a portion of the catalyst material has been leached from the diamond table.

BRIEF SUMMARY

In some embodiments, the present disclosure includes a cutting element for an earth-boring tool. The cutting element includes a substrate and at least one volume of superabrasive material on the substrate. The at least one volume of superabrasive material includes a first planar surface and a second planar surface oriented at an angle relative to the first planar surface and intersecting the first planar surface along an apex. The first planar surface has a circular or oval shape having a first maximum diameter, and the second planar surface has a circular or oval shape having a second maximum diameter. The apex has a length less than the first maximum diameter and the second maximum diameter.

In additional embodiments, the present disclosure includes an earth-boring tool that comprises a cutting element attached to a body. The cutting element includes at least one volume of superabrasive material on a substrate. The at least one volume of superabrasive material has a first planar surface and a second planar surface oriented at an angle relative to the first planar surface and intersecting the first planar surface along an apex. The first planar surface has a circular or oval shape having a first maximum diameter, and the second planar surface has a circular or oval shape having a second maximum diameter. The apex has a length less than the first maximum diameter and the second maximum diameter.

In yet further embodiments, the present disclosure includes a method of forming an earth-boring tool in which at least one cutting element is selected that includes at least one volume of superabrasive material on a substrate. The at least one volume of superabrasive material has a first planar surface and a second planar surface oriented at an angle relative to the first planar surface and intersecting the first planar surface along an apex. In addition, the first planar surface has a circular or oval shape having a first maximum diameter, and the second planar surface has a circular or oval shape having a second maximum diameter. The apex has a length less than the first maximum diameter and the second maximum diameter. The selected at least one cutting element is attached to a body of an earth-boring tool.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

FIG. 1A is a top perspective view of the plow-shaped cutting element;

FIG. 1B is a front perspective view of the plow-shaped cutting element;

FIG. 1C is a side perspective view of the plow-shaped cutting element;

DETAILED DESCRIPTION

The illustrations presented herein are not actual views of any particular earth-boring tool, cutting element, or component thereof, but are merely idealized representations that are employed to describe embodiments of the present disclosure.

As used herein, the term "earth-boring tool" means and includes any tool used to remove formation material and form a bore (e.g., a wellbore) through the formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

Figure 1A:
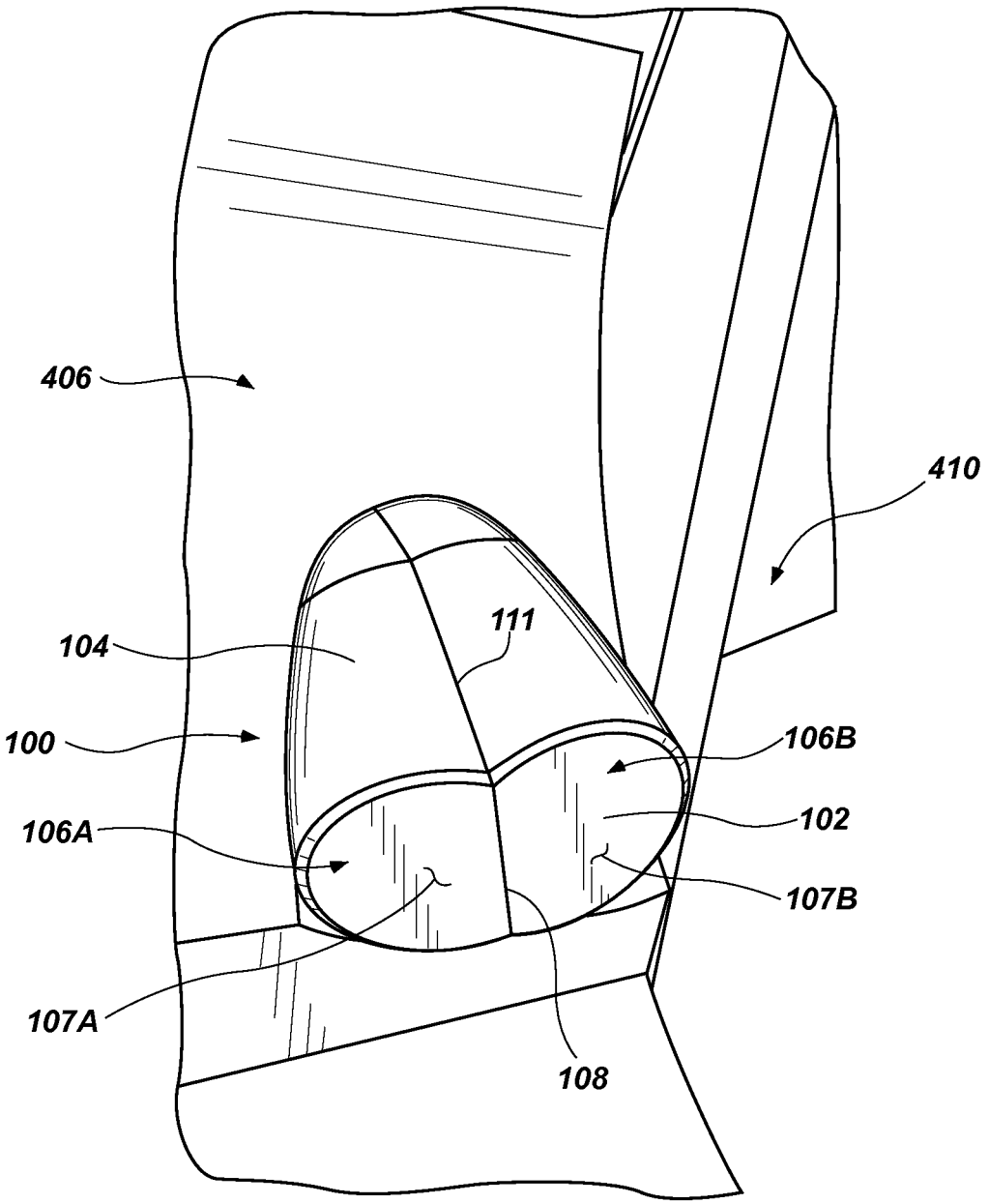
FIGS. 1A-1C are perspective views illustrating an example embodiment of a plow-shaped cutting element of the disclosure mounted to a body of an earth-boring tool.
Figure 1B:
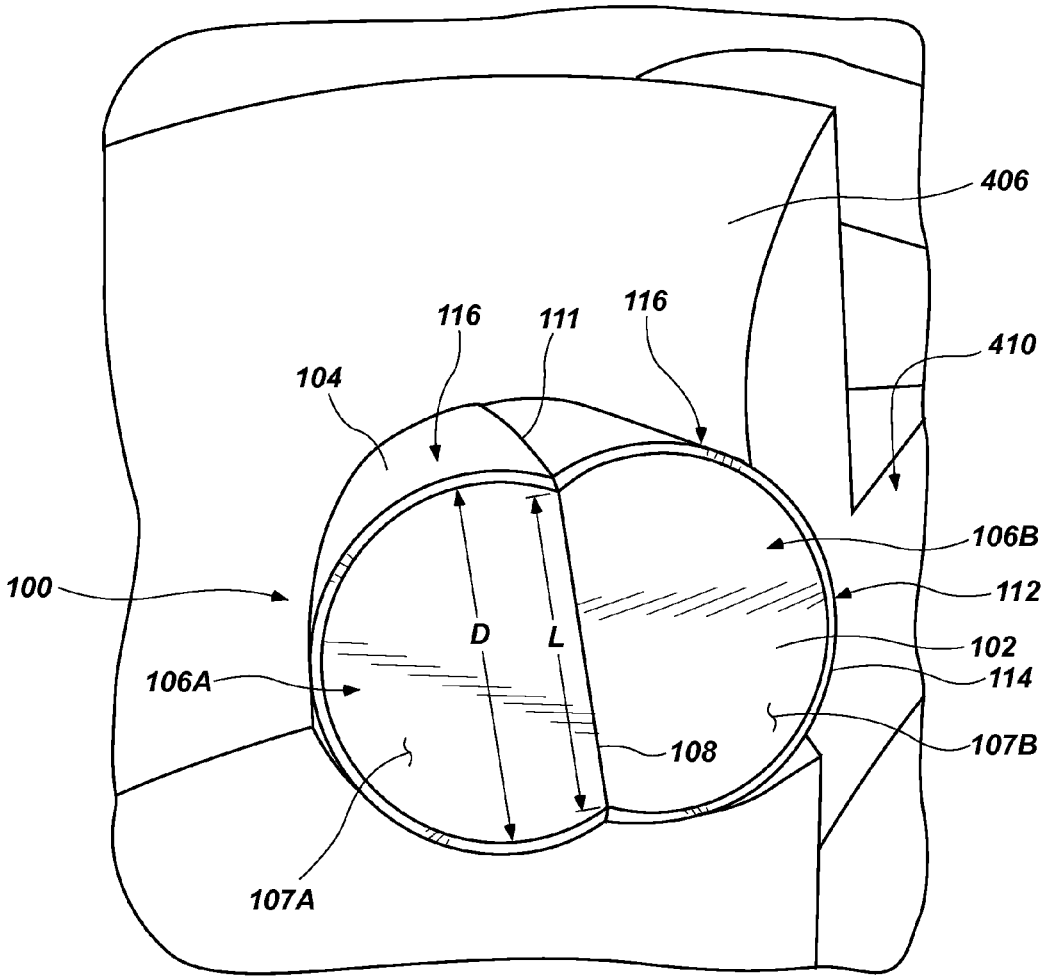
Figure 1C:
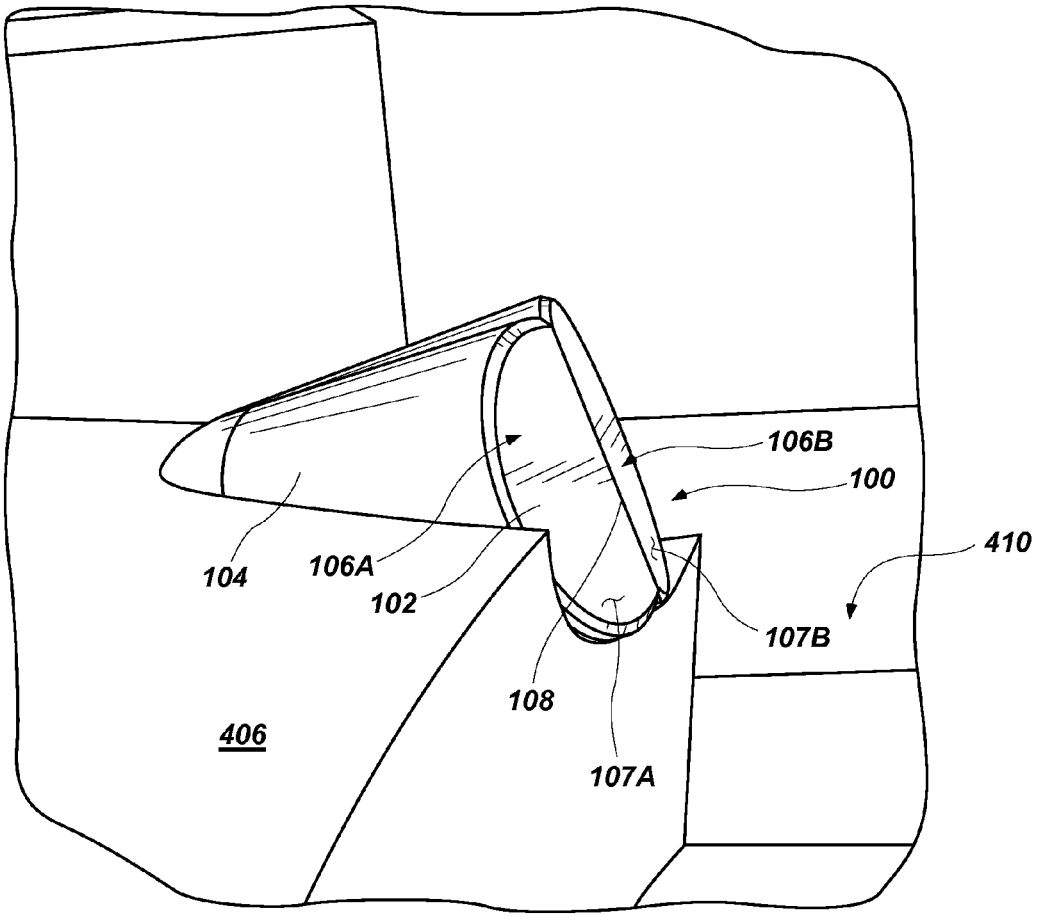

FIGS. 1A-1C illustrate an example embodiment of a plow-shaped cutting element 100 of the present disclosure. The plow-shaped cutting element 100 includes a superabrasive material 102, such as polycrystalline diamond or polycrystalline cubic boron nitride, disposed on one or more surfaces of a substrate 104. The superabrasive material 102 may be formed on the surfaces of the substrate 104 using a high temperature, high pressure (HTHP) process, or the superabrasive material 102 may be formed separately from the substrate 104 and subsequently bonded to the substrate 104. The substrate 104 may comprise a wear-resistant material, such as, for example, a cemented carbide material (e.g., cobalt-cemented tungsten carbide). In some embodiments, the substrate 104 may have a tapered geometry extending away from the outer lateral periphery of the superabrasive material 102, which may define a cutting edge of the cutting element 100, and toward a central longitudinal axis of the cutting element 100.

The superabrasive material 102 may comprise a first layer 106A or "table" of the superabrasive material 102 and a second layer 106B of the superabrasive material 102, although the first and second layers 106A, 106B may be different regions of a single, unitary body of the superabrasive material 102 in some embodiments. The first layer 106A has a first generally planar front cutting face 107A, and the second layer 106B has a second generally planar front cutting face 107B. The generally planar front cutting surfaces 107A, 107B are oriented at an angle relative to one another such that they are not coplanar, but intersect one another along an apex 108 therebetween and are coextensive with one another. The apex 108 may be linear (e.g., not curved).

Each surface 107A, 107B may have a shape comprising a portion of a circle or an oval, and may have a shape comprising more than 50% of a circle or an oval. In this configuration, as shown in FIG. 1B, the length L of the apex 108 extending along the intersection between the surfaces 107A, 107B may be less than the maximum diameters D of the circles or ovals of the surfaces 107A, 107B. In some embodiments, the length L of the apex 108 may be about 95% or less of each of the maximum diameters D of the surfaces 107A, 107B, about 90% or less of each of the maximum diameters D of the surfaces 107A, 107B, or even about 85% or less of each of the maximum diameters D of the surfaces 107A, 107B. The first and second surfaces 107A, 107B may be identical or they may be different in size, shape, and/or orientation (e.g., angle relative to a longitudinal axis of the cutting element 100).

In this configuration, the cutting element 100 may include a concave notch 111 on opposing sides of the cutting element 100. The notches 111 may extend longitudinally along the cutting element 100 in the lateral side surfaces of the volume of superabrasive material 102 and in the lateral side surfaces of the substrate 104.

In some embodiments, the first and second layers 106A, 106B of the superabrasive material 102 may be generally planar and may have an at least substantially constant layer thickness. In other embodiments, the first and second layers 106A, 106B may not be planar, and may have a varying layer thickness.

Figure 2:
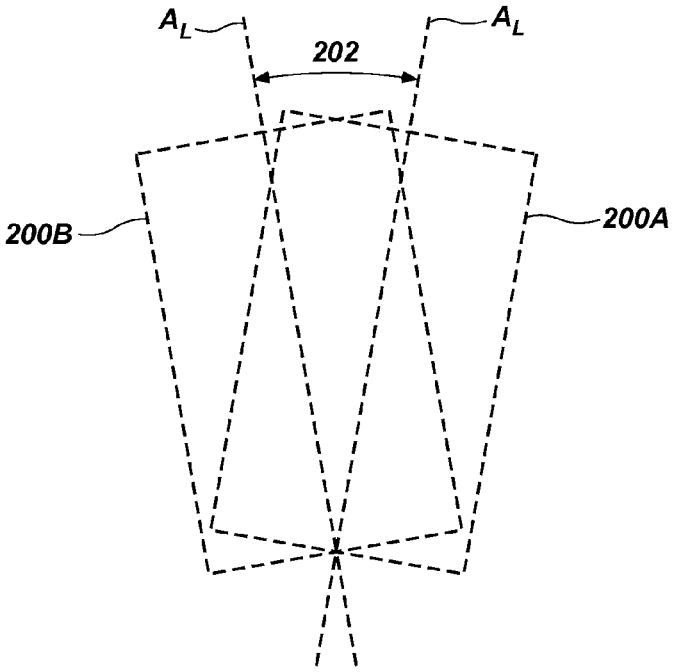
FIG. 2 is a schematic top plan view of profiles of two generally cylindrical cutting elements oriented at an acute angle relative to one another, and overlapping one another.

Referring to FIG. 2, the cutting element 100 may be characterized as having a design attained by defining two generally cylindrical cutting elements 200A, 200B each having a longitudinal axis $A_L$, orienting the two generally cylindrical cutting elements 200A, 200B at an acute angle relative to one another (i.e., orienting the two generally cylindrical cutting elements 200A, 200B such that an angle 202 between the longitudinal axes $A_L$ is between about ten degrees and about eighty degrees, or even between about ten degrees and about forty degrees (e.g., about twenty degrees (20°)), and partially overlapping the two generally cylindrical cutting elements 200A, 200B. The generally cylindrical cutting elements 200A, 200B may be identical in shape to one another, or they may be different. In some embodiments, the generally cylindrical cutting elements 200A, 200B may be at least substantially cylindrical, such that the lateral side surfaces of the cutting elements 200A, 200B have a substantially cylindrical shape. In other embodiments, the generally cylindrical cutting elements 200A, 200B may have a tapered geometry, such that the lateral side surfaces of the cutting elements 200A, 200B have a frustoconical shape.

Figure 3:
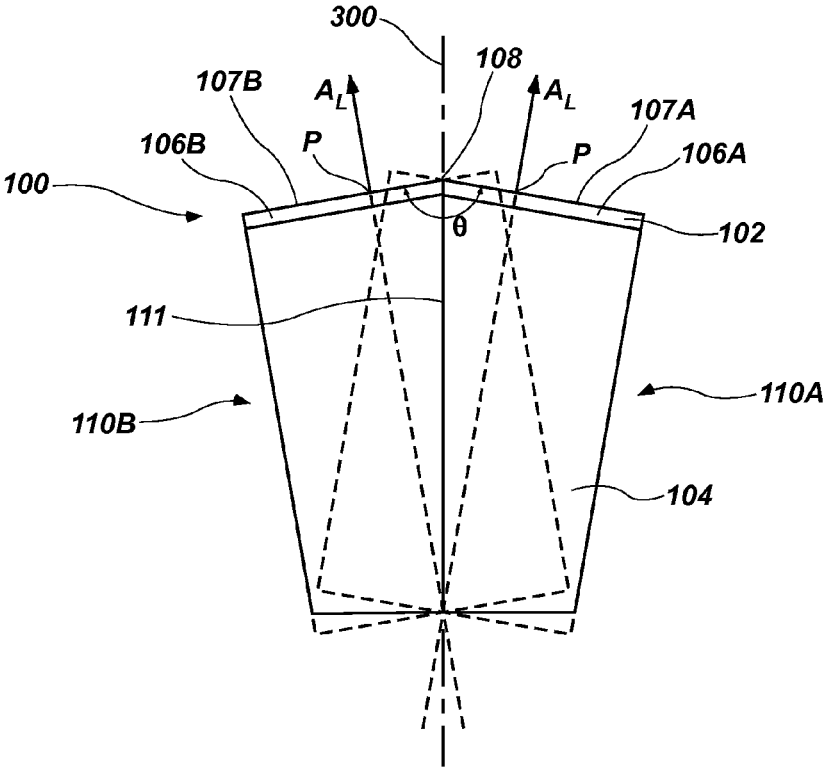
FIG. 3 is similar to FIG. 2 and illustrates a cutting element like that of FIGS. 1A-1C overlying the profiles of the two generally cylindrical cutting elements shown in FIG. 2.

FIG. 3 illustrates the cutting element 100 of FIGS. 1A-1C overlapping the profiles of the generally cylindrical cutting elements 200A, 200B of FIG. 2. As shown in FIG. 3, the cutting element 100 comprises a first half 110A and a second half 110B that meet along a plane 300. In some embodiments, the cutting element 100 may be symmetrical about the plane 300. In other embodiments, the cutting element 100 may be asymmetrical about the plane 300. Each of the two halves 110A, 110B may comprise a portion of a generally cylindrical cutting element (like the cutting elements 200A, 200B) oriented at an acute angle relative to the plane 300 (i.e., the acute angle between the respective longitudinal axes $A_L$ and the plane 300. Thus, a longitudinal axis $A_L$ may be defined for each of the two halves 110A, 110B, which extends along what would be the longitudinal centerline of a generally cylindrical cutting element (like the cutting elements 200A, 200B of FIG. 2), a portion of which defines the respective half 110A, 110B.

Thus, the front cutting surfaces 107A, 107B of each of the layers 106A, 106B of the superabrasive material 102 may have a diameter D (FIG. 1B) that intersects the respective longitudinal axis $A_L$ on the exposed front cutting surfaces 107A, 107B of the generally planar layers 106A, 106B at points P (FIG. 3).

In additional embodiments, the plane 300 may not be disposed along a centerline of the cutting element 100, and the cutting element 100 may not be asymmetric about the plane 300 as previously mentioned.

As previously mentioned, the generally planar front cutting surfaces 107A, 107B are oriented at an angle relative to one another. By way of example and not limitation, an angle θ between the front cutting surfaces 107A, 107B may be between 90° and about 180°, between about 115° and about 175°, or even between about 130° and about 165°.

The cutting element 100 may be fabricated as a single unitary body in some embodiments. In other embodiments, each of the halves 110A, 110B of the cutting element 100 may be separately fabricated from one another and subsequently joined together using, for example, a welding, brazing, sintering, or other bonding process.

The interface between the superabrasive material 102 and the substrate 104 may be tailored for specific performance parameters based on the anticipated drilling application and the expected loads to be applied to the cutting element 100. The geometry of the interface between the superabrasive material 102 and the substrate 104 could be planar, or it could have a three-dimensional geometry tailored to withstand reduce stresses within the cutting element 100 at the interface.

If it is desired to maintain efficient drilling when the cutting element 100 is in a worn condition, the thickness of the superabrasive material 102 may be reduced (e.g., minimized) and may generally conform to the contour of the underlying surface of the substrate 104. In instances where the cutting element 100 is expected to be subjected to high impacts or loads, it may be desirable to provide a relatively thicker layer of the superabrasive material 102 on the substrate 104. Additionally, the thickness of the superabrasive material 102 could vary as previously mentioned. For example, the superabrasive material 102 could have a maximum thickness at the apex 108, and the thickness may decrease in directions extending from the apex 108 to the lateral sides of the cutting element 100.

Figure 4A:
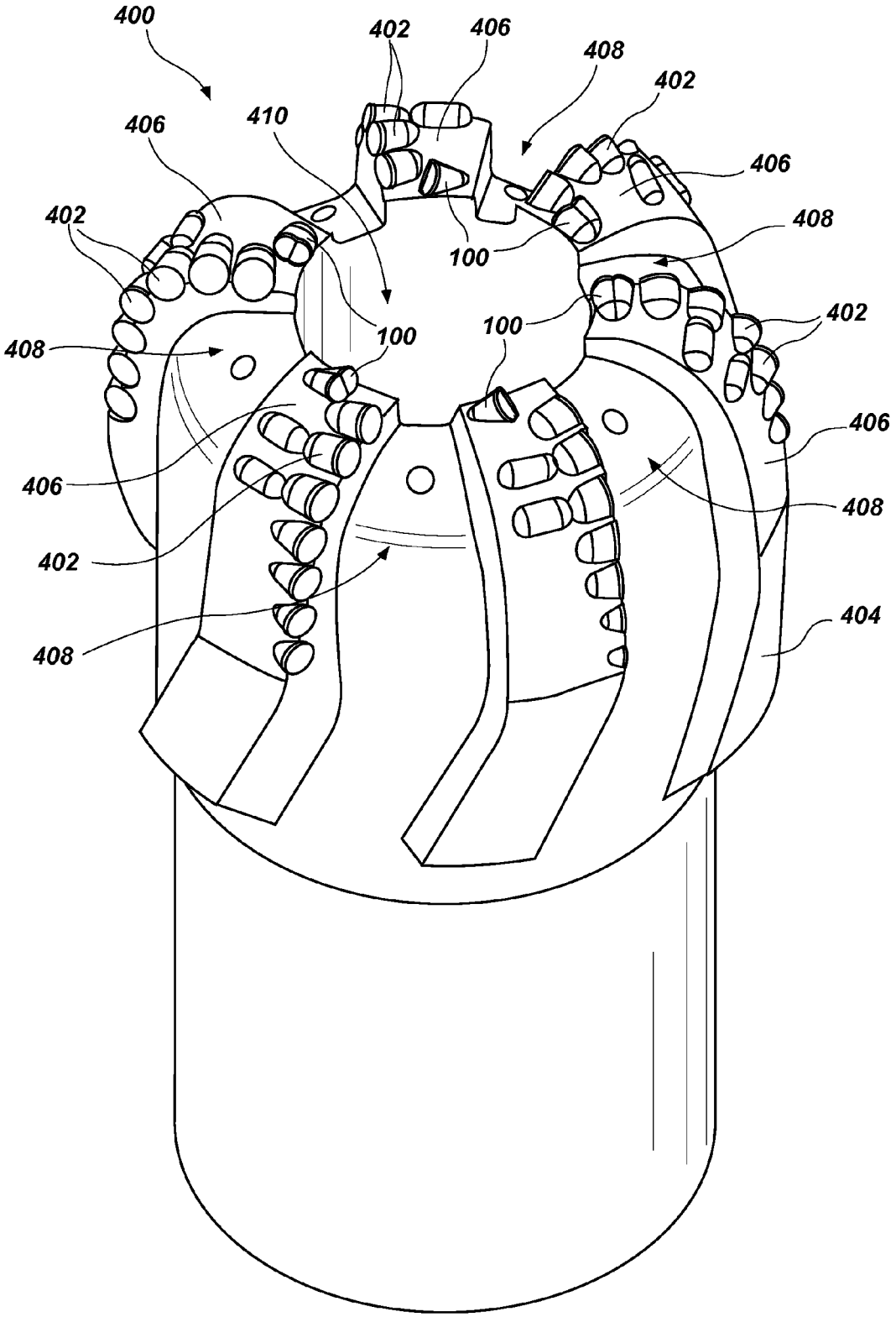
FIG. 4A is a perspective view of an embodiment of a fixed-cutter earth-boring rotary drill bit of the disclosure that may include plow-shaped cutting elements as described herein.
Figure 4B:
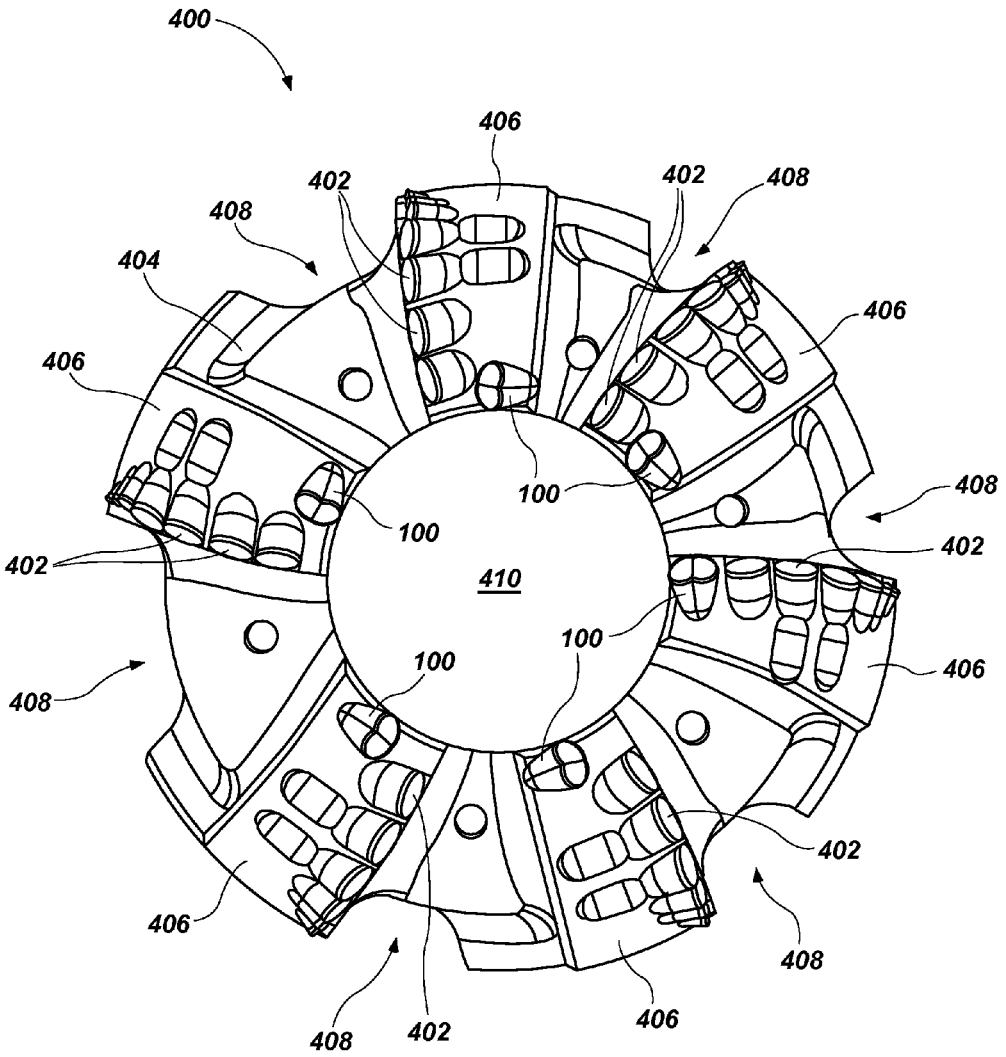
FIG. 4B is a plan view of a leading face of the drill bit shown in FIG. 4A.
Figure 4C:
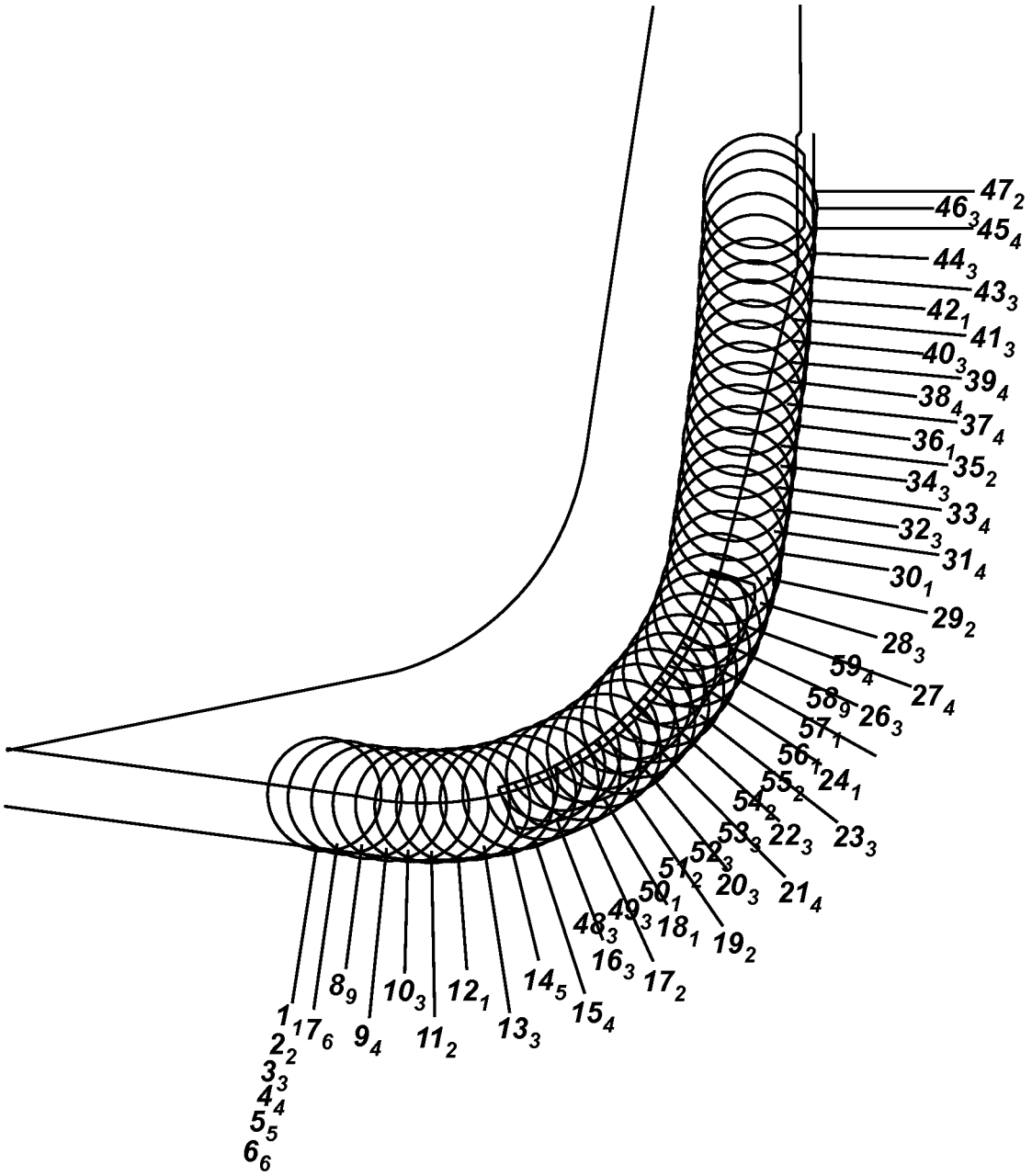
FIG. 4C is a cutting element profile of the drill bit shown in FIGS. 4A and 4B.

Embodiments of cutting elements 100 as described herein with reference to FIGS. 1A-1C and FIG. 3 may be mounted to bodies of earth-boring tools. For example, a fixed-cutter earth-boring rotary drill bit may be equipped with one or more cutting elements 100. As a non-limiting example, FIGS. 4A-4C illustrate a fixed-cutter earth-boring rotary drill bit 400 that may include one or more cutting elements 100. The drill bit 400 shown in FIGS. 4A-4C is a coring bit, and embodiments of cutting elements 100 as described herein may find particular utility in coring bits, although embodiments of the disclosure are not limited to such coring bits.

The coring drill bit 400 of FIGS. 4A-4C includes a body 404, which includes a plurality of blades 406. Fluid courses 408 are defined between the blades 406. A generally cylindrical void 410 is defined at the center of the body 404, such that, as the drill bit 400 drills through a subterranean formation, a generally cylindrical core of the formation extends into the void 410. The generally cylindrical core may be broken off and brought to the surface of the formation for testing and/or analysis, as known in the art.

FIG. 4C illustrates a cutting element profile of the drill bit 400. The cutting element profile illustrates the position of each of the cutting elements 402 rotated into a single plane. As is common in the industry, each cutting element is given an identifying number by consecutively numbering the cutting elements starting with the cutting element closest to the longitudinal centerline of the drill bit being numbered "1," the next closing cutting element 402 to the longitudinal centerline being numbered "2," and continuing in this manner for each of the cutting elements 402 moving radially outward away from the longitudinal centerline of the drill bit 400. As shown in FIG. 4C, the drill bit 400 includes forty-seven (47) cutting elements. Redundant cutting elements 402 may be disposed at the same radial position at some points along the cutting element profile. For example, as shown in FIG. 4C, cutting elements 1 through 6 are disposed at the same radial position and are redundant with one another. As shown in FIG. 4B, these cutting elements 1 through 6 are the cutting elements 402 located on the body 404 adjacent the central void 410, and are the cutting elements 402 that cut and define the formation core that will extend into the void 410 during drilling. In accordance with some embodiments of the present disclosure, one or more of these cutting elements 1 through 6 may comprise a cutting element 100 as described herein.

FIGS. 1A-1C illustrate a cutting element 100 mounted on a blade 406 of such a drill bit 400 adjacent a void 410. The cutting element 100 may be mounted such that the apex 108 extends radially outwardly from the surface of the blade 406 surrounding the cutting element 100. In some embodiments, the cutting element 100 may be oriented such that the apex 108 is at least substantially perpendicular to the surface of the blade 406 surrounding the cutting element 100. For example, the cutting element 100 may be oriented such that the apex 108 is within about five degrees (5°) of perpendicular to the surface of the blade 406 surrounding the cutting element 100, not considering back or forward rake angle of the cutting element 100. Referring to FIG. 1B, in this orientation, the lateral side portion 112 of the periphery 114 of front cutting surface 107B of the second layer 106B remote from the apex 108 will provide the cutting edge that cuts and defines the core of the formation that will extend into the void 410 during drilling. This lateral cutting edge will have an effective back rake angle relative to the core due, at least in part, to the angle of the front cutting surface 107B of the second layer 106B. The top portions 116 of the peripheries 114 of the first and second generally planar surfaces 107A, 107B of the layers 106A, 106B (from the perspective of FIG. 1B) will cut the formation in the path of the drill bit 400 (FIGS. 4A-4C), thereby allowing the drill bit 400 to advance further into the formation during drilling. These top cutting edges will have an effective side rake angle relative to the formation due, at least in part, to the angle of the front cutting surfaces 107A, 107B of the layers 106A, 106B relative to the direction of movement of the cutting element 100 during drilling.

The geometry of the plow-shaped cutting elements 100 described herein may deflect formation cuttings away from the cutting elements 100 and into the fluid courses 408 of the drill bit 400 in an efficient manner. Additionally, the wear flat(s) that develop on the plow-shaped cutting elements 100 during drilling may be relatively smaller compared to at least some previously known cutting elements due, at least in part, to the geometry of the cutting elements 100, which may improve the performance of drill bits including such cutting elements 100 in at least some applications. In coring bits, the cutting elements 100 may be used to provide efficient cutting of the formation core when the cutting elements 100 are located in relatively convenient locations on the blades 406 at which conventional cutting elements may not be capable of providing equally efficient cutting of the formation core.

Cutting elements 100 as described herein may be employed on any other type of earth-boring tool, in addition to fixed-cutting coring bits.

Additional non-limiting embodiments of the disclosure are set forth below.

Embodiment 1

A cutting element for an earth-boring tool, comprising: a substrate; and at least one volume of superabrasive material on the substrate, the at least one volume of superabrasive material including a first planar surface and a second planar surface oriented at an angle relative to the first planar surface and intersecting the first planar surface along an apex; wherein the first planar surface has a circular or oval shape having a first maximum diameter, the second planar surface has a circular or oval shape having a second maximum diameter, and the apex has a length less than the first maximum diameter and the second maximum diameter.

Embodiment 2

The cutting element of Embodiment 1, wherein the superabrasive material comprises at least one of polycrystalline diamond and cubic boron nitride.

Embodiment 3

The cutting element of Embodiment 1 or Embodiment 2, wherein the at least one volume of superabrasive material comprises: a first layer of superabrasive material on a first region of the substrate; and a second layer of superabrasive material on a second region of the substrate.

Embodiment 4

The cutting element of Embodiment 3, wherein the first layer of superabrasive material and the second layer of superabrasive material are integral portions of a single volume of the superabrasive material.

Embodiment 5

The cutting element of any one of Embodiments 1 through 4, wherein the apex is linear.

Embodiment 6

The cutting element of any one of Embodiments 1 through 5, wherein the length of the apex is about 95% or less of each of the first maximum diameter and the second maximum diameter.

Embodiment 7

The cutting element of Embodiment 6, wherein the length of the apex is about 90% or less of each of the first maximum diameter and the second maximum diameter.

Embodiment 8

The cutting element of Embodiment 7, wherein the length of the apex is about 85% or less of each of the first maximum diameter and the second maximum diameter.

Embodiment 9

The cutting element of any one of Embodiments 1 through 8, wherein the angle between the first planar surface and the second planar surface is between 90° and about 180°.

Embodiment 10

The cutting element of Embodiment 9, wherein the angle between the first planar surface and the second planar surface is between about 115° and about 175°.

Embodiment 11

The cutting element of Embodiment 10, wherein the angle between the first planar surface and the second planar surface is between about 130° and about 165°.

Embodiment 12

An earth-boring tool, comprising: a body; and at least one cutting element as recited in any one of Embodiments 1 through 11 attached to the body.

Embodiment 13

The earth-boring tool of Embodiment 12, wherein the earth-boring tool comprises a fixed-cutter rotary drill bit.

Embodiment 14

The earth-boring tool of Embodiment 13, wherein the fixed-cutter rotary drill bit comprises a coring bit having a generally cylindrical void defined at a center of the body.

Embodiment 15

The earth-boring tool of Embodiment 14, wherein the at least one cutting element is attached to the body at a location adjacent the generally cylindrical void, the at least one cutting element located and configured such that a lateral cutting edge of the at least one cutting element defined at a periphery of one of the first planar surface and the second planar surface remote from the apex will cut and define a core sample of a formation when the coring bit is used to drill through the formation.

Embodiment 16

A method of forming an earth-boring tool, comprising: selecting at least one cutting element to comprise a cutting element as recited in any one of Embodiments 1 through 11, and attaching the at least one cutting element to a body of an earth-boring tool.

Embodiment 17

A method of forming a cutting element as recited in any one of Embodiments 1 through 11.

Although the foregoing description contains many specifics, these are not to be construed as limiting the scope of the present invention, but merely as providing certain embodiments. Similarly, other embodiments of the invention may be devised which do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A cutting element for an earth-boring tool, comprising:

a substrate; and at least one volume of superabrasive material on the substrate, the at least one volume of superabrasive material including a first planar surface and a second planar surface oriented at an angle relative to the first planar surface and intersecting the first planar surface along an apex;

wherein the first planar surface has a first shape comprising more than half of a circle or more than half of an oval, the first shape having a first maximum diameter, the second planar surface has a second shape comprising more than half of a circle or more than half of an oval, the second shape having a second maximum diameter, and the apex has a length less than the first maximum diameter and the second maximum diameter, wherein notches extend in a lateral side surface of the at least one volume of superabrasive material on opposing sides adjacent the apex.

2. The cutting element of claim 1, wherein the superabrasive material comprises at least one of polycrystalline diamond and cubic boron nitride.

3. The cutting element of claim 1, wherein the at least one volume of superabrasive material comprises:

a first layer of superabrasive material on a first region of the substrate; and a second layer of superabrasive material on a second region of the substrate.

4. The cutting element of claim 3, wherein the first layer of superabrasive material and the second layer of superabrasive material are integral portions of a single volume of the superabrasive material.

5. The cutting element of claim 1, wherein the apex is linear.

6. The cutting element of claim 1, wherein the length of the apex is about 95% or less of each of the first maximum diameter and the second maximum diameter.

7. The cutting element of claim 6, wherein the length of the apex is about 90% or less of each of the first maximum diameter and the second maximum diameter.

8. The cutting element of claim 7, wherein the length of the apex is about 85% or less of each of the first maximum diameter and the second maximum diameter.

9. The cutting element of claim 1, wherein the angle between the first planar surface and the second planar surface is between 90° and about 180°.

10. The cutting element of claim 9, wherein the angle between the first planar surface and the second planar surface is between about 115° and about 175°.

11. The cutting element of claim 10, wherein the angle between the first planar surface and the second planar surface is between about 130° and about 165°.

12. An earth-boring tool, comprising:

a body; and at least one cutting element attached to the body, the at least one cutting element including at least one volume of superabrasive material on a substrate, the at least one volume of superabrasive material having a first planar surface and a second planar surface oriented at an angle relative to the first planar surface and intersecting the first planar surface along an apex, wherein the first planar surface has a first shape comprising more than half of a circle or more than half of an oval, the first shape having a first maximum diameter, the second planar surface has a second shape comprising more than half of a circle or more than half of an oval, the second shape having a second maximum diameter, and the apex has a length less than the first maximum diameter and the second maximum diameter, wherein notches extend in a lateral side surface of the at least one volume of superabrasive material on opposing sides adjacent the apex.

13. The earth-boring tool of claim 12, wherein the earth-boring tool comprises a fixed-cutter rotary drill bit.

14. The earth-boring tool of claim 13, wherein the fixed-cutter rotary drill bit comprises a coring bit having a generally cylindrical void defined at a center of the body.

15. The earth-boring tool of claim 14, wherein the at least one cutting element is attached to the body at a location adjacent the generally cylindrical void, the at least one cutting element located and configured such that a lateral cutting edge of the at least one cutting element defined at a periphery of one of the first planar surface and the second planar surface remote from the apex will cut and define a core sample of a formation when the coring bit is used to drill through the formation.

16. The earth-boring tool of claim 12, wherein the apex is linear.

17. The earth-boring tool of claim 16, wherein the length of the apex is about 95% or less of each of the first maximum diameter and the second maximum diameter.

18. The earth-boring tool of claim 17, wherein the angle between the first planar surface and the second planar surface is between about 115° and about 175°.

19. The earth-boring tool of claim 18, wherein the angle between the first planar surface and the second planar surface is between about 130° and about 165°.

20. A method of forming an earth-boring tool, comprising:

selecting at least one cutting element to include at least one volume of superabrasive material on a substrate, the at least one volume of superabrasive material having a first planar surface and a second planar surface oriented at an angle relative to the first planar surface and intersecting the first planar surface along an apex, wherein the first planar surface has a first shape comprising more than half of a circle or more than half of an oval, the first shape having a first maximum diameter, the second planar surface has a second shape comprising more than half of a circle or more than half of an oval, the second shape having a second maximum diameter, and the apex has a length less than the first maximum diameter and the second maximum diameter, wherein notches extend in a lateral side surface of the at least one volume of superabrasive material on opposing sides adjacent the apex; and attaching the at least one cutting element to a body of an earth-boring tool.

* * * * *